US005228401A

United States Patent [19]

Moore, III

[11] Patent Number: 5,228,401

[45] Date of Patent: Jul. 20, 1993

[54] SEWING MACHINE AND PANTOGRAPH DRIVE, BRACKET, BOOM, AND HOOP ASSEMBLY

[75] Inventor: Edgar F. Moore, III, Greensboro, N.C.

[73] Assignee: Barudan America Inc., Walton Hills, Ohio

[21] Appl. No.: 762,921

[22] Filed: Sep. 19, 1991

[51] Int. Cl.[5] ..... D05B 21/00; D05C 9/06

[52] U.S. Cl. ..... 112/103; 112/121.12; 112/121.15

[58] Field of Search ..... 112/102, 103, 119, 121.11, 112/121.12, 121.15, 121.26, 262.3, 266.1, 303, 306, 311, 320; 33/22, 23.03, 23.06, 25.1, 25.3, 25.5, 23.02, 23.04; 38/102, 102.1, 102.2

[56] References Cited

U.S. PATENT DOCUMENTS

| | | | |
|---|---|---|---|
| 3,037,472 | 6/1962 | Lockwood | 112/102 X |
| 3,848,323 | 11/1974 | Perger | 29/457 X |
| 4,152,994 | 5/1979 | Sugiyama | 112/121.12 |
| 4,195,581 | 4/1980 | Ohara | 112/103 |
| 4,357,885 | 11/1982 | Stockton | 112/103 |
| 4,365,564 | 12/1982 | Sugiyama | 112/121.12 |
| 4,386,573 | 6/1983 | Davidson et al. | 112/103 |
| 4,495,876 | 1/1985 | Tajima | 112/103 |
| 4,945,643 | 8/1990 | Goldfarb | 33/234.0 |
| 5,005,501 | 4/1991 | Kita | 112/103 X |
| 5,029,536 | 7/1991 | Kambara et al. | 112/311 X |
| 5,097,777 | 3/1992 | Porter et al. | 112/262.3 |

FOREIGN PATENT DOCUMENTS

| | | | |
|---|---|---|---|
| 0466269 | 1/1992 | European Pat. Off. | 38/102.2 |
| 1260052 | 10/1989 | Japan | 112/103 |
| 3130456 | 6/1991 | Japan | 112/103 |
| 2090436 | 7/1982 | United Kingdom | 112/121.12 |
| 2125073 | 2/1984 | United Kingdom | 112/103 |

OTHER PUBLICATIONS

Metals Handbook, "Forming", Eigth Edition, American Society for Metals, 1969 ©, pp. 125-126.

*Primary Examiner*—Clifford D. Crowder
*Assistant Examiner*—Ismael Izaguirre

[57] ABSTRACT

Sewing apparatus utilizes a conventional multi-head sewing machine for embroidering or stitching and includes a single rail pantograph with a double ended electric motor and ribbed drive end and support arm. A multi-purpose holding bracket allows the operator to quickly change from embroidering tubular goods such as sweatshirts to baseball caps or other circular type goods without tools by the use of an easily releasable hoop support boom. An embroidery hoop assembly provides ears which can be easily and securely positioned on the hoop support boom for secure holding thereto during high speed embroidering operations. The ribs on the drive end of the pantograph prevent warping of the end during the high speed operations.

18 Claims, 10 Drawing Sheets

SEWING MACHINE AND PANTOGRAPH DRIVE, BRACKET, BOOM, AND HOOP ASSEMBLY

BACKGROUND OF THE INVENTION

1. Field Of The Invention

The invention herein pertains to machines and apparatus for sewing, and particularly to commercial multi-head sewing machines which utilize pantographs for embroidering and stitching along multiple stations.

2. Description Of The Related Art

Multi-head sewing machines have been used for many years in industry for embroidering shirts, caps and other articles and for placing trademarks on several garments and other articles simultaneously. In order to insure identical stitching, multi-head sewing machines employ computer driven pantographs which allow all the sewing heads to perform the identical stitch simultaneously, for example at ten or more sewing stations (sewing heads). As customers have become more and more demanding regarding the precision of the stitching or embroidery work, various improvements have been made to rectangular and single rail or T-shaped pantographs. However, in high velocity embroidering on multi-head sewing machines, it is not uncommon for the stitch or pattern to be "out of register" at various sewing heads. This can be due in part to various reasons one of which is the pantograph slightly bending or buckling during rapid movement. Such buckling or warping by the pantograph can cause unacceptable embroidering and can be quite costly at sewing machine speeds of seven hundred fifty stitches per minute or more which is not uncommon with modern sewing equipment. In addition to problems associated with the movement of the pantograph, it has also been found that the mechanisms by which the embroidery hoops are held on the machine are often not properly secured and many times the embroidery hoops slip or slightly move during stitching. This also can contribute to an unacceptable embroidery design or pattern. Additionally, there has also been a need in the past to develop hoop assembly holding devices for pantographs which can be quickly and easily exchanged so the machine operators can embroider baseball caps for example in the morning and that afternoon can embroider tubular goods such as sweatshirts, with only minimal machine down-time.

Thus, with the problems and disadvantages of prior art sewing and embroidering equipment, the present invention was conceived and one of its objectives is to provide a multi-head sewing machine apparatus having a drive mechanism which accurately and efficiently moves a pantograph on a sewing machine table.

It is another objective of the present invention to provide a drive mechanism for a pantograph as used on a high speed multi-head sewing machine which will prevent the pantograph from warping or bending during rapid directional changes.

It is still another objective of the present invention to provide an improved pantograph which includes a reinforced ribbed drive end for more accurate, positive pantograph movement.

It is also an objective of the present invention to provide a multi-purpose holding bracket for a pantograph whereby cap frames or tubular article frames can be affixed thereto and can be easily and rapidly exchanged as desired with minimal labor.

It is yet another objective of the present invention to provide a hoop support boom which will rigidly hold an embroidery hoop assembly and which will securely engage the multi-purpose holding bracket.

It is also another objective of the present invention to provide improved hoop ears for embroidery hoops which will provide a more stable hoop position of the hoop assembly on the pantograph during high speed embroidering.

It is an additional objective of the present invention to provide a multi-purpose holding bracket having a rapid releasable, slidable frame receiver for securely holding cap frames or the like.

Various other objectives and advantages of the present invention become more apparent to those skilled in the art as a more detailed presentation is set forth below.

SUMMARY OF THE INVENTION

The invention herein pertains to sewing machine apparatus, particularly for use with multi-head sewing machines as are commercially employed for embroidering, stitching and the like. An improved T-shaped single rail pantograph is movably affixed to the sewing machine table for controlling the motion of a plurality of embroidering hoops or cap securing frames. The pantograph has a ribbed drive end to insure accurate movement without warping or bending and to drive the pantograph along its longitudinal axes. The drive mechanism utilizes a double belt drive system having a dual electric motor therebetween. A plurality of drive rollers are positioned on a transverse member joined to the belts for a more accurate response to the movement commands. A series of support arms are affixed to the table top between the sewing heads for stabilizing and increasing the accuracy of the pantograph movement. A series of multi-purpose holding brackets are affixed to the pantograph along the rail for releasably holding hoop support booms at each sewing station. The multi-purpose holding bracket will also accept a cap frame or the like for stitching on circular goods such as baseball caps. The hoop support boom includes a holding member for engaging slotted hoop ears for quick insertion and release after the embroidery pattern is complete.

BRIEF DESCRIPTION OF THE DRAWINGS

To illustrate the invention and its novel components, the following drawings are provided.

DESCRIPTION OF THE PREFERRED EMBODIMENT

Figure 1:
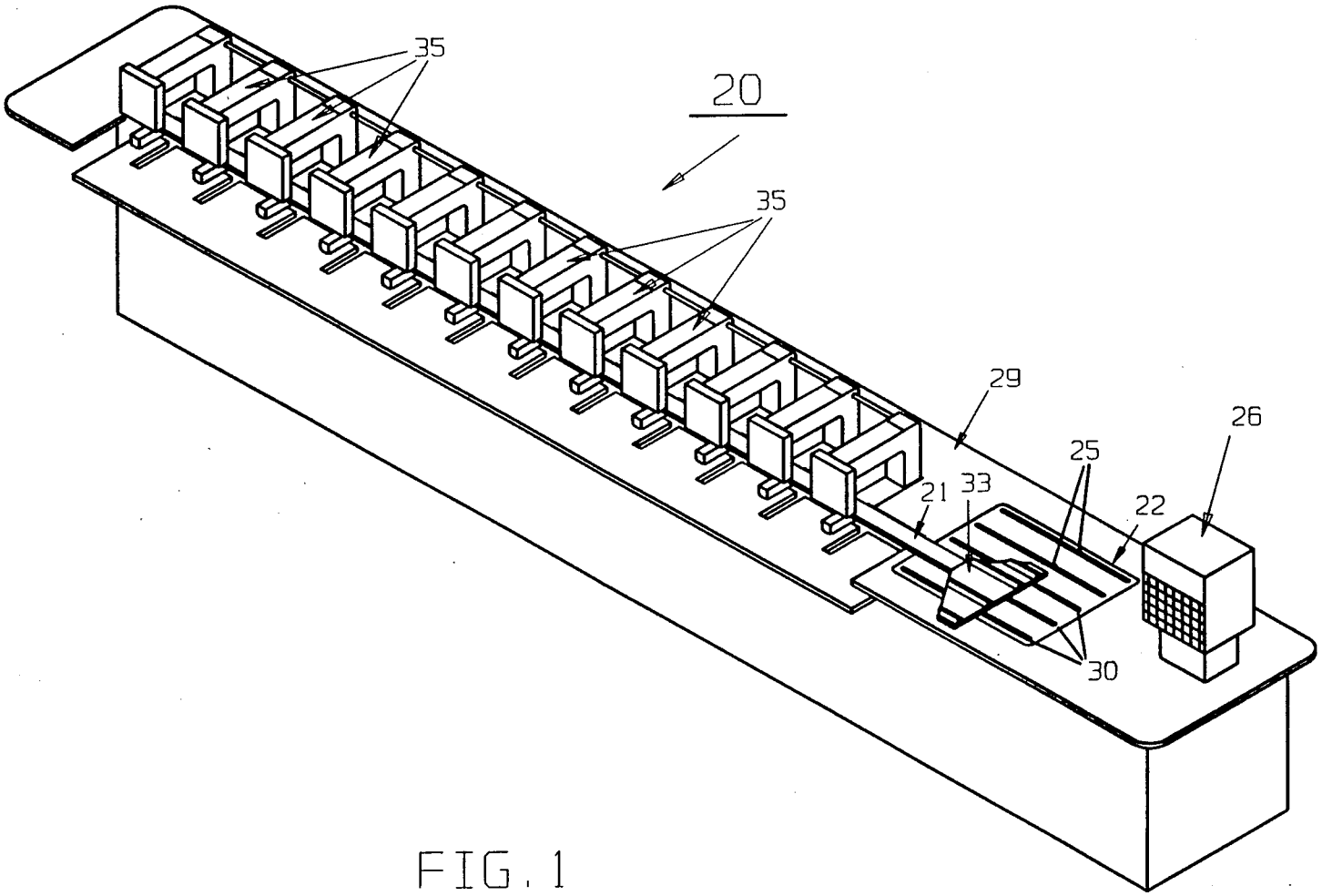
FIG. 1 illustrates a perspective view of a conventional multi-head sewing machine to which the invented features have been adapted.
Figure 2:
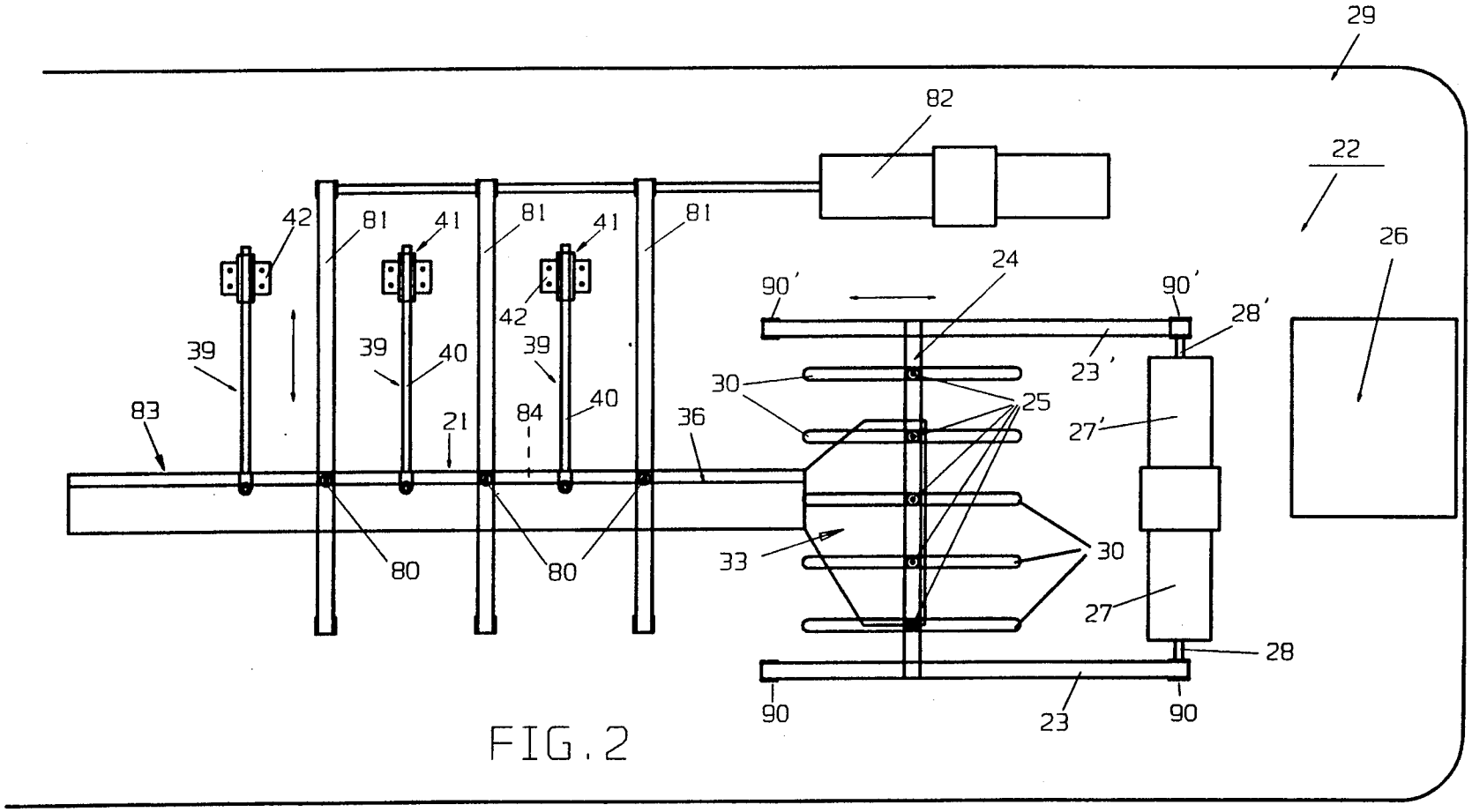
FIG. 2 depicts a top schematic view of the pantograph and drive mechanism.
Figure 3:
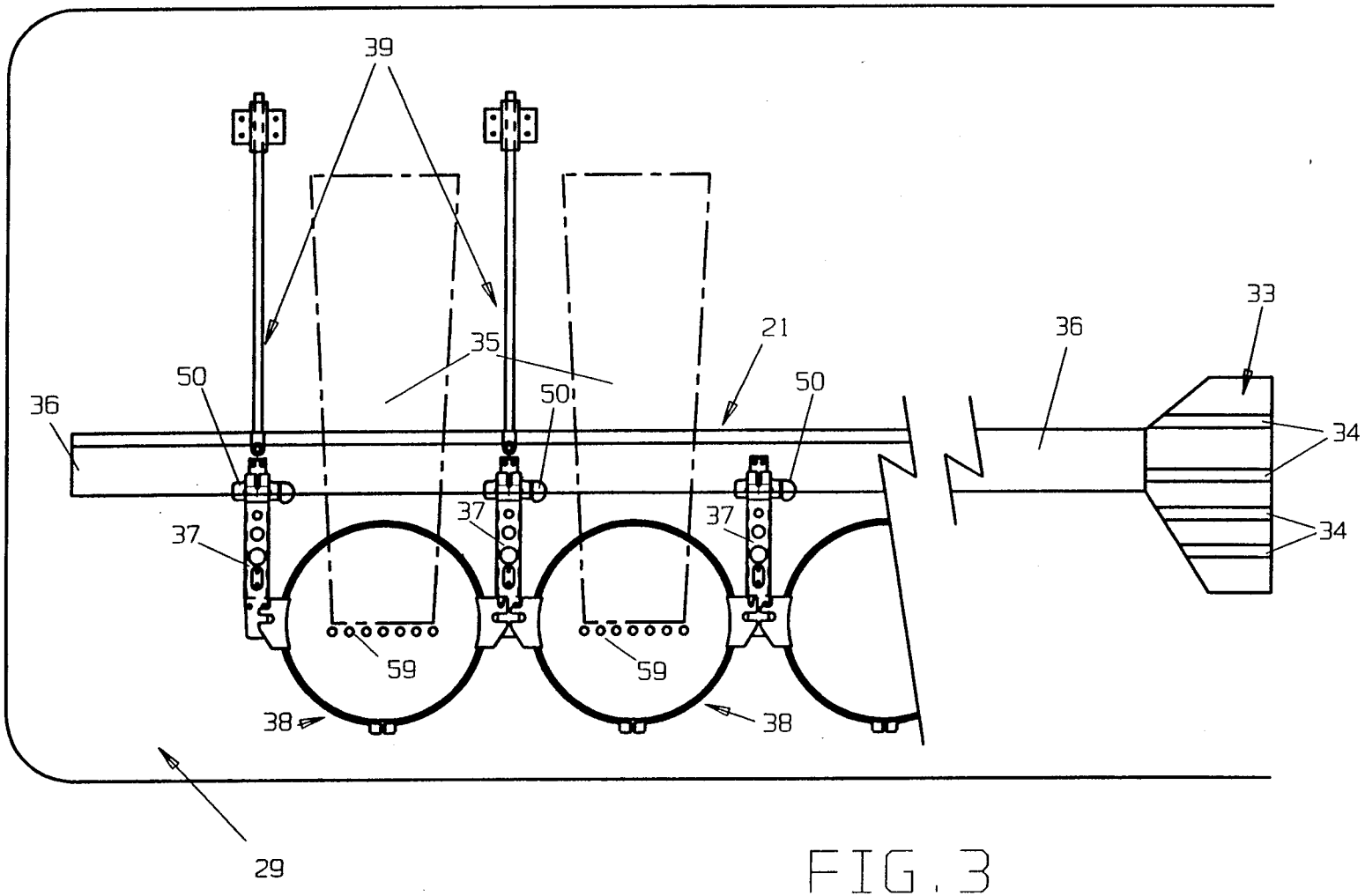
FIG. 3 shows a top view of the pantograph with hoop support booms affixed thereto and embroidery hoops thereon.

The preferred forms and features of the invention are illustrated in FIGS. 1–13 which clearly show the sewing apparatus employing the improved T-shaped pantograph attached to the sewing apparatus of FIG. 1 consisting of a multi-head sewing machine which has been adapted to operate the improved T-shaped pantograph of FIGS. 2 and 3. Said pantograph is driven by the mechanism of FIG. 2 and is supported for consistent and stable operation on the sewing machine table top by support arms as featured in FIG. 6.

Figure 8:
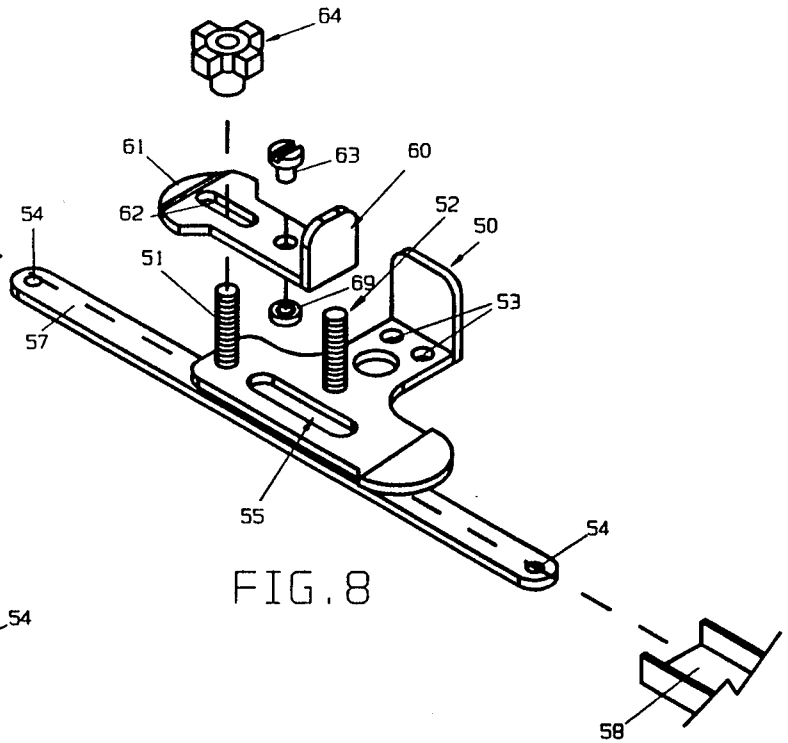
FIG. 8 demonstrates the multi-purpose bracket with a slidable frame receiver exploded therefrom.
Figure 7:
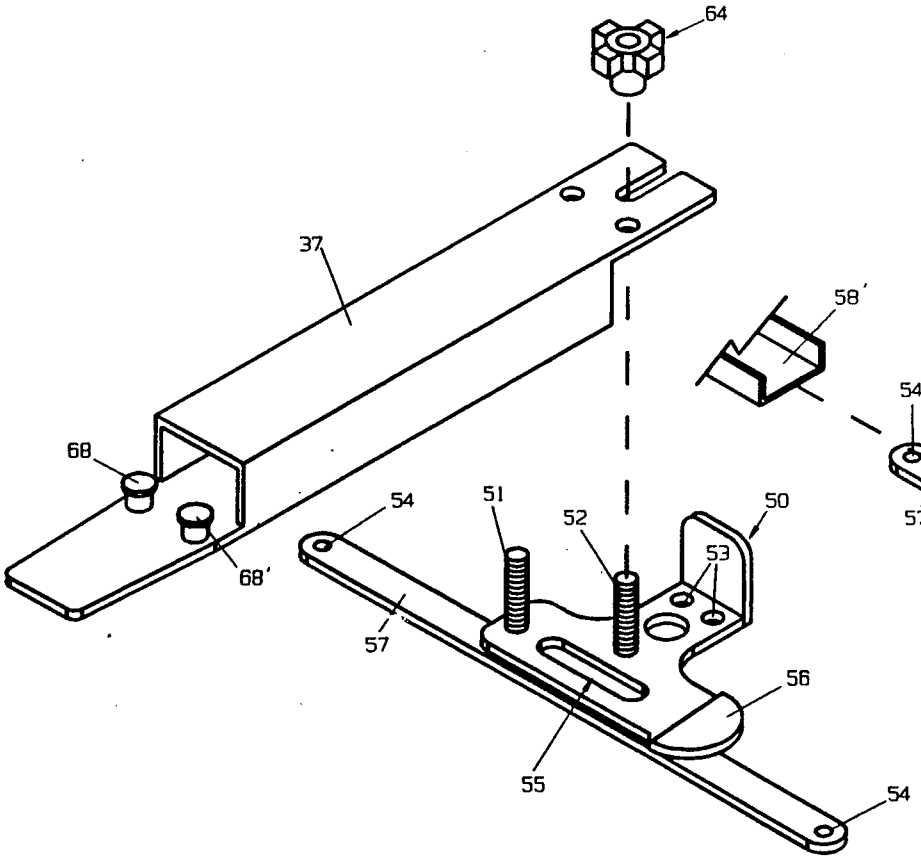
FIG. 7 shows a hoop support boom exploded from the multi-purpose bracket of the invention.

In order to sew or embroider a variety of goods, a multi-purpose holding bracket as seen in FIGS. 7 and 8 demonstrates the versatility for holding a cap frame during embroidering as illustrated in FIG. 8 and a support boom as shown in FIG. 7 which can be used for tubular goods.

Figure 13:
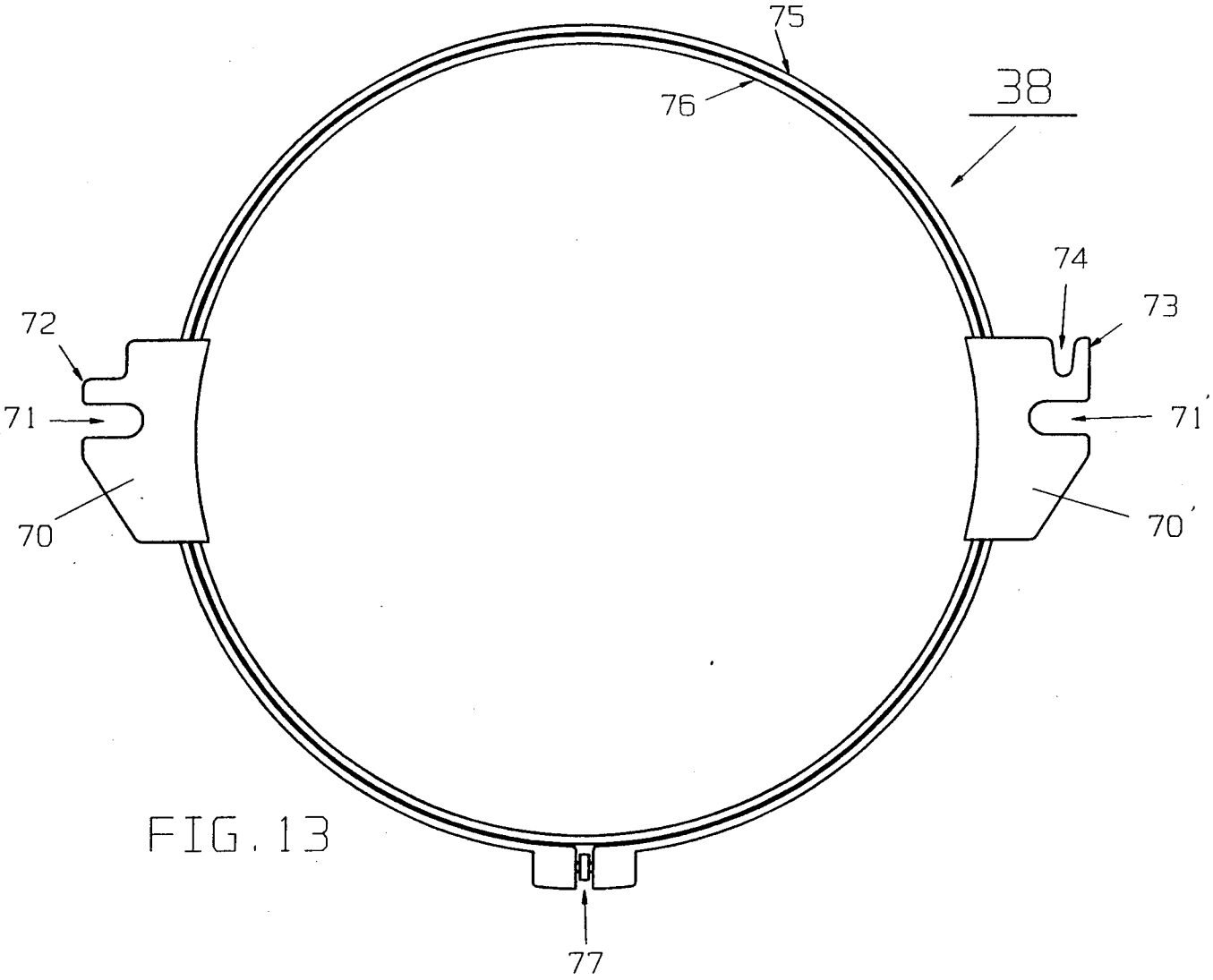
FIG. 13 shows a conventional embroidery hoop having the ears as shown in FIG. 12 thereon.

The preferred embroidery hoop ears are shown in FIGS. 12 and 13, with FIG. 13 illustrating the ears in place on engaged embroidery hoops.

Figure 4:
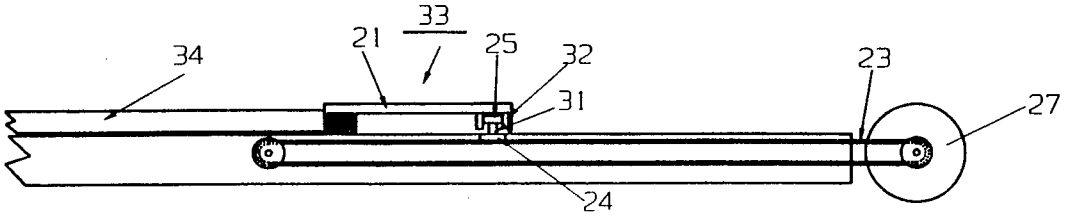
FIG. 4 illustrates a front elevational view of the exposed drive mechanism of the pantograph as generally illustrated along line 4—4 of FIG. 2.
Figure 5:
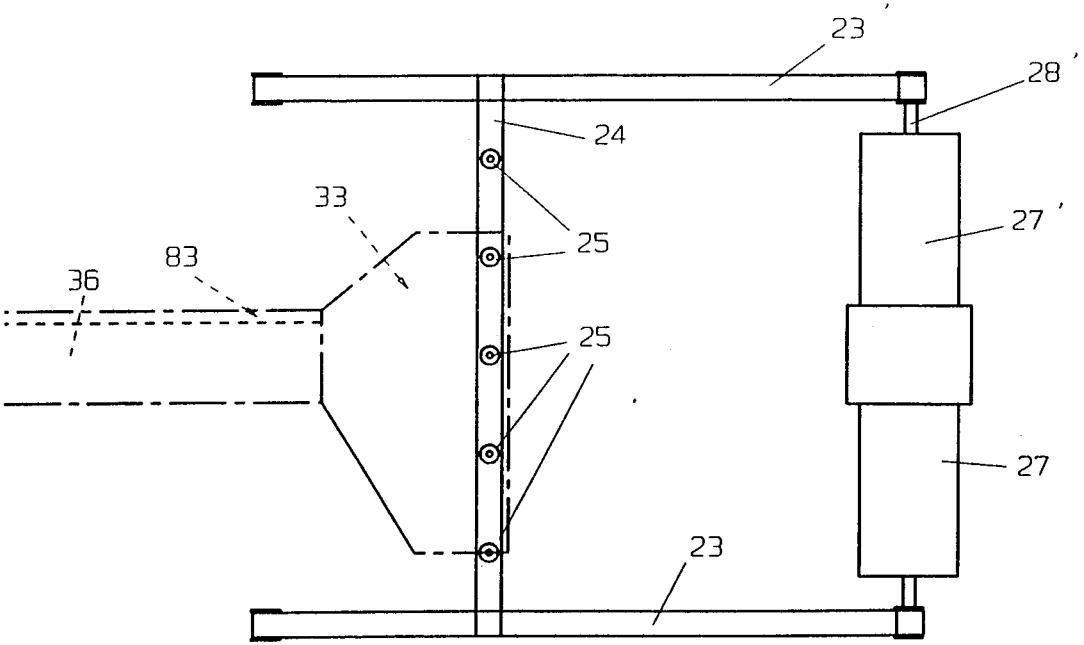
FIG. 5 demonstrates a top view of the transverse member affixed to the drive as shown in FIG. 4.

For a more complete understanding of the invention and its operation, turning now to the drawings, sewing apparatus 20 consisting of a multi-head sewing machine is shown in FIG. 1 having pantograph 21 movably attached thereto. Pantograph 21 is a single rail T-shaped pantograph which is moved by drive mechanism 22 as shown in FIG. 2. Sewing apparatus 20 includes twelve (12) sewing heads 35 or stations. Pantograph 21 is controlled by drive mechanism 22 as more clearly illustrated in FIG. 2. Drive mechanism 22 includes belts 23, 23′ which move transverse member 24 for directing drive rollers 25 to and from the machine controls, generally shown at 26. As further seen in FIG. 2, transverse member 24, through belts 23, 23′ is driven by dual electric motors 27, 27′ which are united by a central shaft (not shown). Motor 27 drives shaft 28 and pulley 90 whereas motor 27′ drives shaft 28′ and pulley 90′. Sewing table 29 as seen in FIG. 1 includes a series of five (5) slots 30 through which roller axles 31 pass (see FIG. 4). Rollers 25 fit within u-shaped channel 32 of pantograph drive end 33 as illustrated in FIGS. 4 and 5. As further shown in FIG. 3, pantograph 21 is T-shaped and includes a somewhat wedge-shaped drive end 33 having a series of raised ribs 34 therealong. Ribs 34 strengthen drive end 33 and prevent it from warping during rapid motion of the high speed sewing operations. As depicted, ribs 34 are positioned parallel to the longitudinal axis of pantograph 21. Pantograph rail 36 is joined to drive end 33 and extends longitudinally under sewing heads 35 of sewing apparatus 20 as shown in FIGS. 1 and 3, and behind needles 59. As would be understood, transverse member 24 is moved in accordance with controls 26 (FIG. 1) to thereby move pantograph 21 generally along the longitudinal axis of pantograph rail 36 as seen in FIG. 3. Lateral movement of pantograph 21 results from belt driven rollers 80 (FIG. 2) which are affixed to transverse member 84. Belts 81 which are motor driven by second fractional horsepower dual electric motor 82 in conventional manner from the rear of table 29 drive transverse member 84. Second motor 82 thus moves pantograph 21 front to rear along sewing table 29 and channel 32 (FIG. 4) allows pantograph 21 to move backward and forward along table 29 while rollers 80, within channel 83 drive rail 36 front to rear and rollers 25 drive rail 36, side to side.

Figure 6:
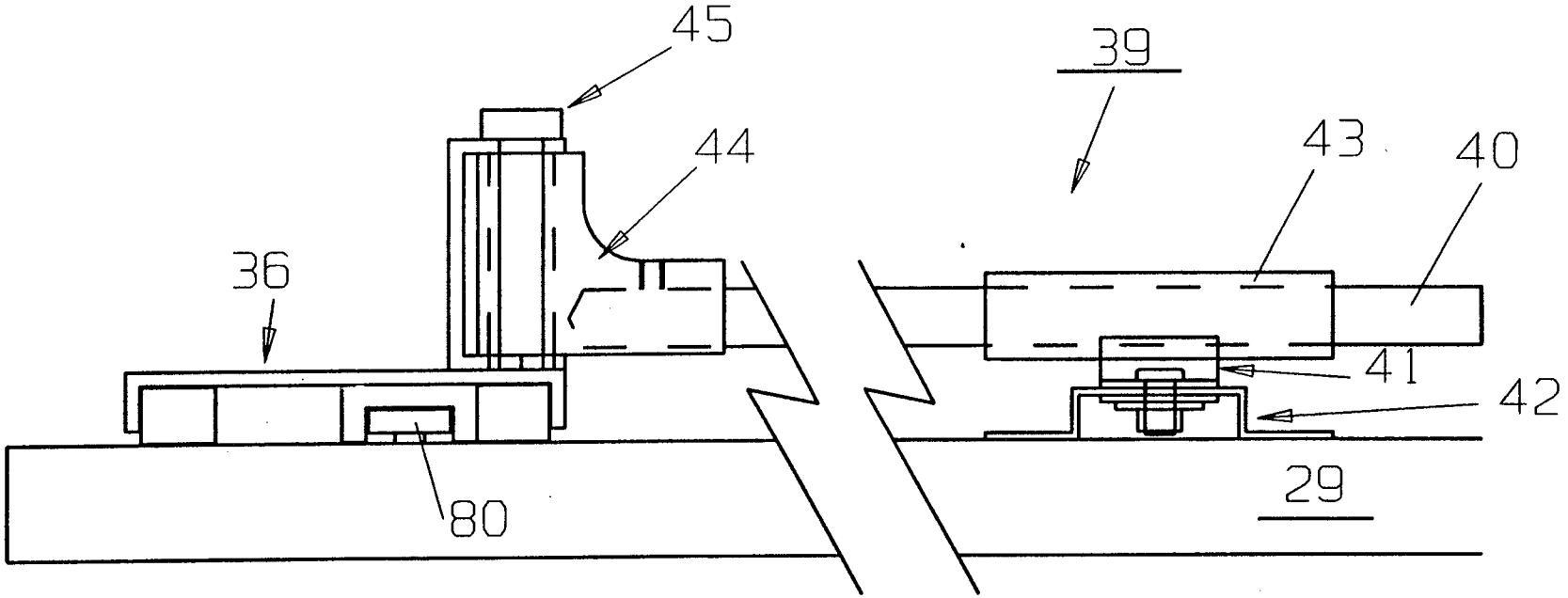
FIG. 6 pictures a side elevational view of one support arm of the pantograph drive mechanism as positioned along the pantograph rail.

In FIG. 3, sewing heads 35 are shown with pantograph 21 therebehind. Extending forward from rail 36 are hoop support booms 37 affixed thereto by T-shaped holding brackets 50 for releasably engaging an embroidery hoop assembly 38 as seen enlarged in FIG. 13. Rail 36 is subject to bend or flex, especially on longer sewing apparatus having six (6) or more heads. In order to insure uniform movement from end to end, with no flexing, pantograph support arm 39 as shown in FIG. 6 is employed. Support arm 39 may comprise a one-half inch steel plated rod 40 which is pivotally mounted in turret 41. Rod 40 will slide along inside of cylindrical turret bushing 43 which, in turn will rotate around turret base 42. Base 42 is affixed to the top of table 29. Rod 40 engages coupling 44 at its end opposite turret base 42. Coupling 44 is pivotally mounted to rail 36 by shoulder bolt 45 which acts as a support arm axle to allow support arm 39 to rotate relative at rail 36.

Figure 9:
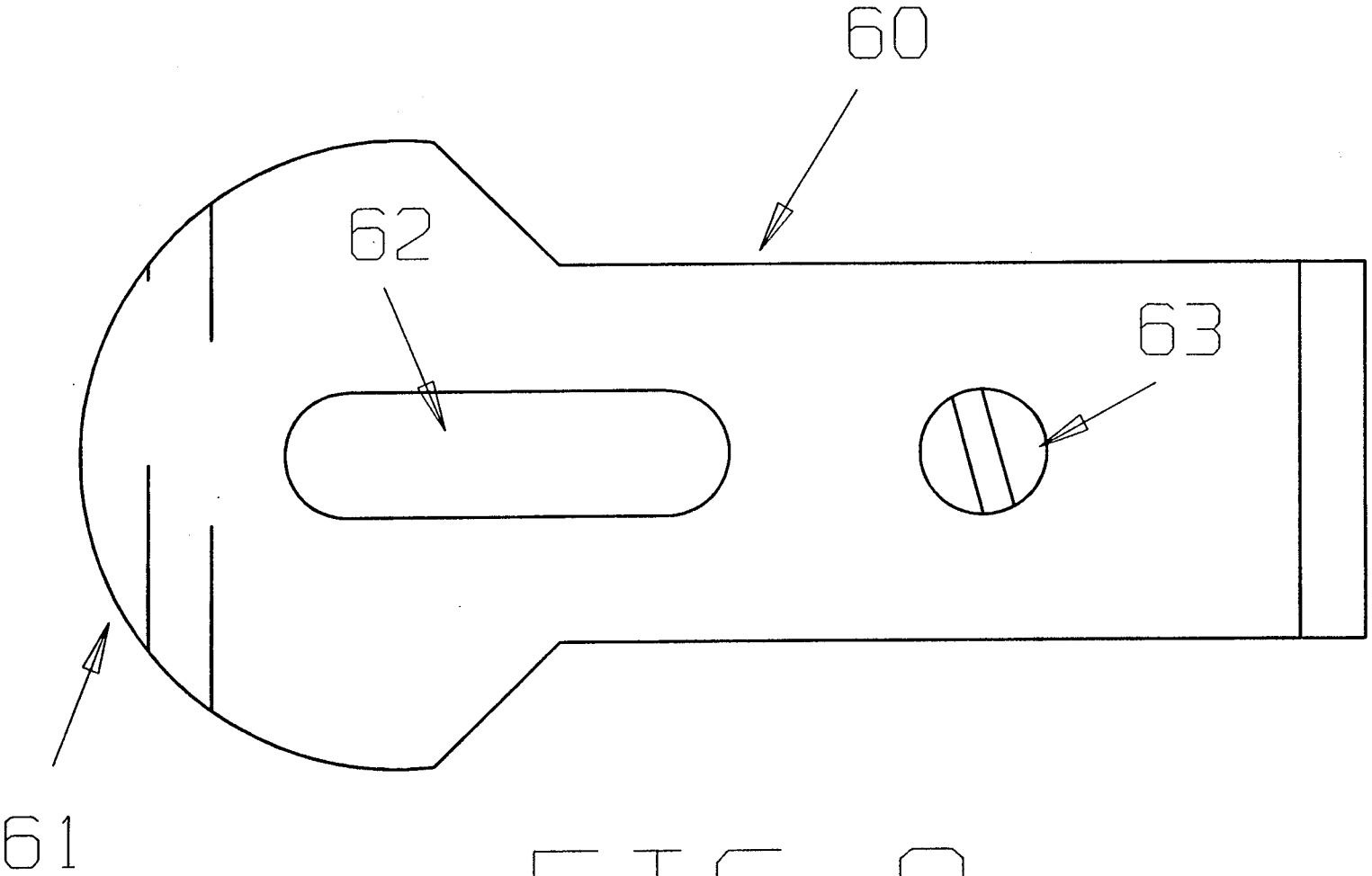
FIG. 9 depicts a top view of the slidable frame receiver as seen in FIG. 8.
Figure 11:
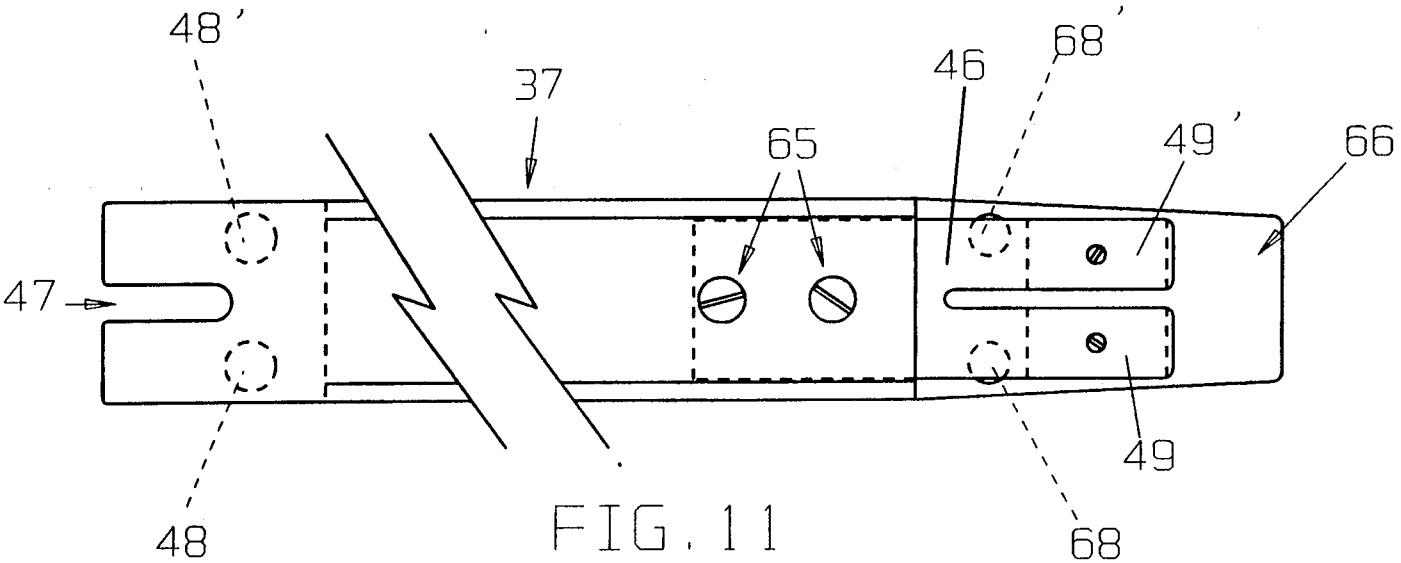
FIG. 11 pictures the hoop support boom of FIG. 10 in a fragmented top plan view.

In FIG. 7 T-shaped holding bracket 50 is attached to pantograph rail 36 (as seen in FIG. 3) for receiving hoop support boom 37. In FIGS. 7 and 8, bracket 50 includes a pair of threaded studs 51, 52 and apertures 53, 54 which act as a means for affixing bracket 50 to rail 36 by machine screws or the like. Slot 55 is positioned proximate studs 51 and 52. Stud 52 of bracket 50 provides a means to releasably affix hoop support boom 37 as shown in FIG. 3. Bracket lip 56 is raised slightly from base bar 57 and acts as a means to receive an embroidery frame end 58 thereunder. Embroidery frame end 58 may be for example, one end of a cap frame as are conventionally known and used in the embroidery trade. In order to attach a corresponding cap frame to rail 36, a means has to be provided for releasably affixing slidably adjustable embroidery frame receiver 60 thereto. FIG. 9 shows a top view of slidable embroidery frame receiver 60 which includes lip 61 for engaging embroidery cap frame end 58′ as shown in FIG. 8. Slidable frame receiver 60 is slotted at 62 for receiving bracket stud 51 therethrough. Slot guide lug 63 extends downwardly through frame receiver 60 and is fastened thereto by nut 69 whereby it projects approximately 3/16 of an inch and during assembly sits within bracket slot 55. When properly adjusted on cap frame end 58′, knob 64 is tightened to securely hold cap frame end 58′ thereto. With frame receiver 60 removed from bracket 50, bracket 50 can then accept hoop support beam 37, as more clearly illustrated in FIGS. 7 and 8.

Figure 10:
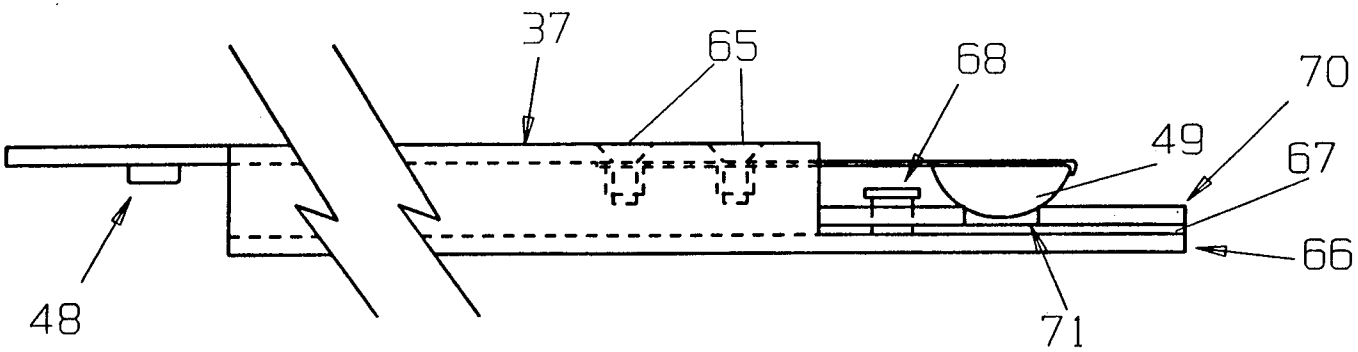
FIG. 10 illustrates a side fragmented view of the hoop support boom with a hoop ear therein.
Figure 12A:
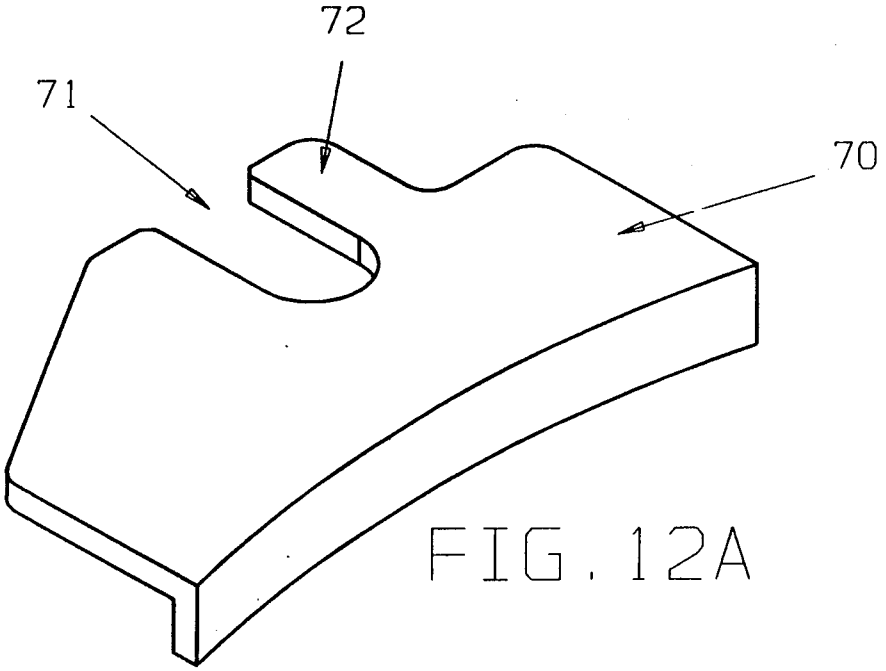
FIGS. 12A and 12B provide respectively, disattached left and right hoop ears of the invention.
Figure 12B:
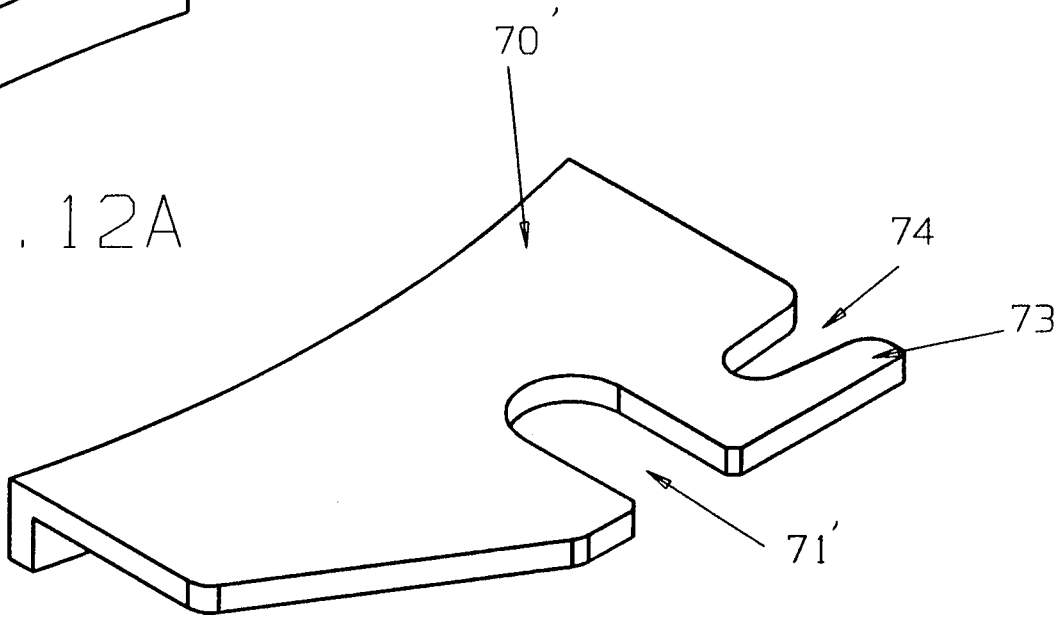

Hoop support boom 37 is shown fragmented in FIG. 10 in a side view with hoop ear 70 therein. As earlier seen in FIG. 7, hoop support boom 37 is releasably engaged by threaded bracket stud 52 which fits within slot 47 of hoop support boom 37. Slot guides 48, 48′ as seen in broken lines in FIG. 11 depend from hoop support boom 37 for reception within bracket slot 55 of bracket 50 to maintain boom 37 rigidly on bracket 50 and prevent movement therealong as knob 64 is tightened onto bracket stud 52. As further shown in FIGS. 10 and 11, hoop support boom 37 includes at its end opposite slot 47 a pair of tension members 49, 49′. Tension members 49, 49′ are resiliently mounted to hoop support boom 37 by resilient spring member 46 which is fastened by screws 65. Resilient member 46 is formed from a thin spring steel to allow tension member 49, 49' to accept hoop ears 70, 70' shown in FIGS. 12A and 12B thereunder. Hoop tension member 49 fits within ear groove 71 to hold embroidery hoop assembly 38 (not shown) in place against shelf 66. Shelf 66 is covered with a thin, friction reducing surface such as polyethylene sheeting 67 which allows ear 70 to slide more easily therealong. Mushroom-shaped post 68, 68' act as a shoulder for stop bar 72 on left ear 70 and on right ear 70', finger 73 engages mushroom-shaped post 68' within finger slot 74. Thus, as would be understood, a pair of hoop support booms 37 can be positioned on pantograph rail 36 on either side of a particular sewing head 35. Hoop assembly 38 as shown in FIG. 13 thus engages one support boom with right ear 70 and another support boom 37 with left ear 70'. Finger 73 prevents lateral movement of embroidery hoop assembly 38 during sewing and when the sewing operation is complete, the operator can simply pull hoop assembly 38 from the pair of hoop support booms 37 whereupon tension members 49, 49' efficiently release ears 70, 70' and another hoop assembly 38 can be quickly installed for embroidering on another garment.

As further shown in FIG. 13 hoop assembly 38 is formed by frictionally engaging conventional outside hoop 75 and inside hoop 76. The correct spacing or frictional mating of hoops 75, 76 can be adjusted by conventional turn screw 77. Ears 70, 70' are mounted to inside hoop 76 and extend outwardly, across outside hoop 75.

The invention as shown herein provides a more accurate and dependable stitch duplication from one end of a multi-head sewing machine to the other and with less down-time and unacceptable "seconds" due to bending or warping of pantograph 21 during high speed sewing operations. While certain embodiments and features of the sewing apparatus have been shown the examples and illustrations herein are not intended to limit the scope of the appended claims.

I claim:

1. In a conventional pantograph drive mechanism for a sewing machine whereby a pantograph moves along a sewing machine table top, said pantograph having a lateral channel beneath a drive end for slidably receiving a pair of rollers, said rollers attached to a transverse member with the transverse member affixed to a belt on a single pulley, said pulley driven by a first motor shaft of a double electric motor, an improvement in the drive mechanism comprising:

a second motor shaft, said second motor shaft affixed to said electric motor and extending in an opposite direction from said first motor shaft, a second pulley affixed to said second motor shaft, a second belt, said second belt driven by said second pulley with said transverse member affixed to said second belt.

2. The improved pantograph drive mechanism of claim 1 including a third roller, said third roller attached on said transverse member is longitudinal alignment with said pair of rollers.

3. The improved pantograph drive mechanism of claim 2 including fourth and fifth rollers, said fourth and fifth rollers attached to said transverse member in longitudinal alignment with said pair of rollers.

4. The improved pantograph drive mechanism of claim 1 including a support arm, a turret, said turret mounted to said table top, said support arm pivotally affixed to said turret, and said support arm pivotally affixed to said pantograph to stabilize said pantograph during movement thereof.

5. The improved pantograph drive mechanism of claim 4 wherein said support arm is further slidably affixed to said turret.

6. The improved pantograph drive mechanism of claim 1 including a plurality of support arms, a plurality of turrets, said turrets mounted to said table top, each of said support arms pivotally, slidably affixed to one of said turrets, said support arms pivotally joined to said pantograph to stabilize said pantograph during movement thereof.

7. In a single rail pantograph having a T-shape for use on a multi-head sewing machine, the improvement comprising: a drive end, said drive end driven by an electric motor, said motor comprising a pair of opposingly extending drive shafts, said drive end comprising a ribbed surface, said surface to strengthen said drive end to prevent warping during use.

8. A bracket for attachment to a pantograph comprising:

a substantially T-shaped member, means to attach said T-shaped member to said pantograph, said attaching means positioned within said T-shaped member, first means to releasably affix a hoop support boom thereto, said T-shaped member defining a slot, said slot having a front and a rear, said first affixing means positioned rearward of said slot on said T-shaped member whereby said hoop support boom is received within said slot and is releasably affixed to said T-shaped member.

9. The bracket of claim 8 including a first means for receiving an embroidery frame, said first receiving means attached to said T-shaped member.

10. The bracket of claim 9 wherein said first receiving means comprises a raised lip.

11. The bracket of claim 8 including a means to releasably affix a slidable embroidery frame receiver thereto, said affixing means attached to said T-shaped member.

12. The bracket of claim 11 wherein said embroidery frame receiver affixing means comprises a stud, a knob and said knob threadably attached to said stud.

13. The bracket of claim 11 including a slidable embroidery frame receiver, said slidable receiver comprising a base, a guide, said guide connected to said base, said base defining a slot, whereby a stud is received in said base slot and said guide is received in said T-shaped bracket slot for slidable movement therewith.

14. The bracket of claim 8 wherein said first hoop support boom affixing means comprises a stud, a knob and said knob threadably attached to said stud.

15. The bracket of claim 8 wherein said attaching means comprises an aperture defined by said T-shaped member.

16. A hoop support boom for attachment to a pantograph for holding an embroidery hoop assembly, said hoop support boom comprising a tension member, said tension member mounted to said support boom, a shelf, said shelf affixed to said support boom proximate said tension member for capturing a hoop assembly between said tension member and said shelf, a shelf stud, said shelf stud mounted on said shelf for engagement with a hoop ear.

17. An elongated hoop support boom for attachment of said support boom to a pantograph bracket, said support boom comprising: an end of said boom defining a slot, a slot guide, said guide affixed to said boom, said slot for engaging with a bracket stud, said slot guide for reception within a bracket slot for releasably connecting said support boom to said bracket, a tension member, said tension member affixed at the other end of said boom from said slot, a shelf, said shelf joined to said boom and extending from said support boom beneath said tension member whereby a hoop frame is captured between said tension member and said shelf.

18. In an embroidery hoop assembly having an outer hoop and an inner hoop said outer hoop adjustably frictionally engagable with said inner hoop for maintaining an embroidable material therebetween, one of said hoops having a pair of ears for releasable engagement with a hoop support boom, the assembly comprising:

one of said holding ears defining a recess, a stop bar, said bar attached to said ear, said recess proximate said stop bar, said recess for receiving a resilient hoop support boom member, the other of said pair of ears defining a recess, a stud finger, said stud finger positioned proximate said recess, said recesses for mounting said hoop assembly on said hoop support boom.

* * * * *